United States Patent [19]

De Brouckere et al.

[11] Patent Number: 4,591,221

[45] Date of Patent: May 27, 1986

[54] ELECTRICALLY CONDUCTIVE DEVICE

[75] Inventors: Lucien C. De Brouckere, Stekene; Ludo M. J. Caers, Edegem; Karel H. Verbert, Kalmthout, all of Belgium

[73] Assignee: International Standard Electric Corporation, New York, N.Y.

[21] Appl. No.: 562,316

[22] Filed: Dec. 16, 1983

[30] Foreign Application Priority Data

Dec. 22, 1982 [BE] Belgium ..... 59973

[51] Int. Cl.[4] ..... H01R 31/08; H01R 13/53

[52] U.S. Cl. ..... 339/19; 339/111; 339/DIG. 3

[58] Field of Search ..... 339/19, 17 LC, 222, 339/111, DIG. 3

[56] References Cited

U.S. PATENT DOCUMENTS

| | | | |
|---|---|---|---|
| 2,379,942 | 7/1945 | Webber | 339/60 R |
| 3,648,108 | 3/1972 | Bailey | 339/19 X |
| 3,951,496 | 4/1976 | LeRouzic | 339/19 |
| 4,108,522 | 8/1978 | Fauale | 339/19 |
| 4,179,178 | 12/1979 | Bachman et al. | 339/19 X |
| 4,220,386 | 9/1980 | Kenny | 339/DIG. 3 X |
| 4,245,274 | 1/1981 | MacDonald et al. | 339/150 B X |
| 4,329,008 | 5/1982 | Braginetz | 339/17 LC X |

FOREIGN PATENT DOCUMENTS

| | | | |
|---|---|---|---|
| 998129 | 10/1976 | Canada | 339/19 |
| 3011512 | 10/1981 | Fed. Rep. of Germany | 339/19 |
| 1514988 | 6/1978 | United Kingdom | 339/19 |

OTHER PUBLICATIONS

J. W. Molyneux Child, "Electrostatic Discharge Damage—The Real Threat" in *Electronics Industry,* Apr. 1982, pp. 62–64.

*Primary Examiner*—Gil Weidenfeld
*Assistant Examiner*—Steven C. Bishop
*Attorney, Agent, or Firm*—T. L. Peterson; R. C. Turner

[57] ABSTRACT

A connector containing male contacts is made of an electrically conductive material. The male contacts cooperate with female contacts buried inside a conventional connector to prevent electrostatic charges from building up between the female contacts.

8 Claims, 3 Drawing Figures

ELECTRICALLY CONDUCTIVE DEVICE

BACKGROUND OF THE INVENTION

The present invention relates to an electrically conductive device for electrically interconnecting contacts of a connector.

Such a device is generally known in the art and its purpose is to prevent electrostatic charges from building up between the contacts of the connector when the latter is not in use or to remove such electrostatic charges as these might otherwise damage electronic components, especially MOS components, connected to the connector contacts. The danger of such electrostatic charges is explained in the article "Electrostatic Device Damage the Real Threat" published in *Electronics Industry* April 1982, pp. 62–64. In the prior art electrically conductive means are known which are adapted to electrically interconnect the contacts of a male connector during storage of the latter. One such known means is an electrically conductive U-shaped element adapted to be clipped on a row of male contacts. Another known means is an electrically conductive foam adapted to be fixed on one or more rows of male contacts. However, these means cannot be used for electrically interconnecting the buried contacts of a female connector.

An object of the invention is to provide an electrically conductive device of the above type but suitable for the electric interconnection of buried contacts.

SUMMARY OF THE INVENTION

According to the present invention there is provided an electrically conductive device in the form of a connector containing a plurality of electrically interconnected contacts adapted to cooperate with corresponding contacts in a conventional connector. The electrically conductive connector establishes an electrical connection of all the contacts in the conventional connector and, thus, prevents electrostatic charges from building up between the latter contacts or removes such differential charges.

DESCRIPTION OF THE PREFERRED EMBODIMENTS

Figure 1:
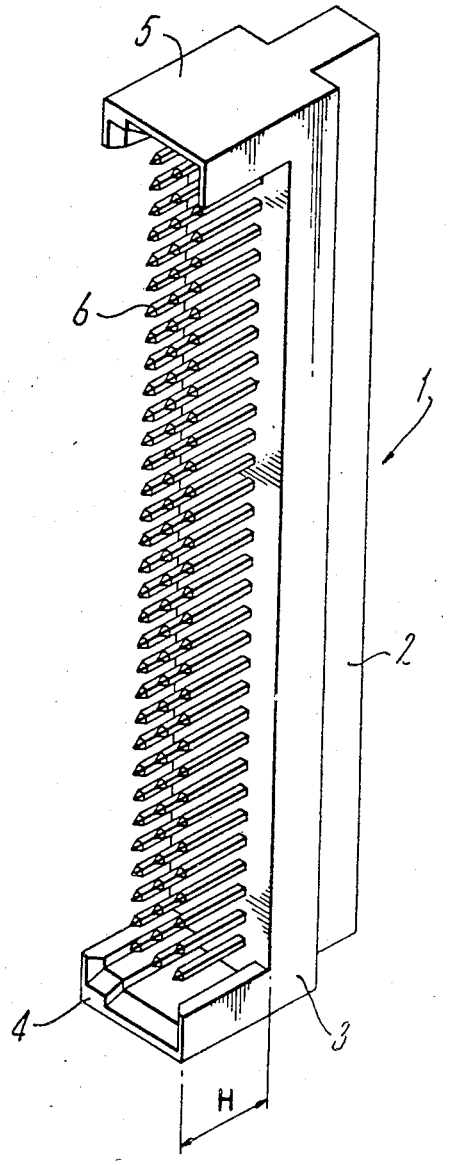
FIG. 1 is a perspective view of an electrically conductive device, more particularly of a male connector, according to the invention.

The male connector 1 shown in FIG. 1 includes a handle-shaped rear part 2 and a U-shaped front part comprising a beam-shaped bottom part 3 and two end flanges 4 and 5. The height of the flanges 4 and 5 measured above bottom 3 is equal to H. A plurality of pin-shaped male contacts 6 are fixed in holes in the bottom part 3 and extend parallel to the flanges 4 and 5. At least the bottom part 3 and preferably the whole connector 1 is made of an electrically conductive plastic material generally available on the market, e.g., STAT KON R15 manufactured by the US firm Liquid Nitrogen Processing Corporation. This material is such that the electric resistance measured between two adjacent male contacts 6 is between 200 ohms and 1 megohm. A minimum resistance is required in order to avoid large currents during short-circuitry.

Figure 2:
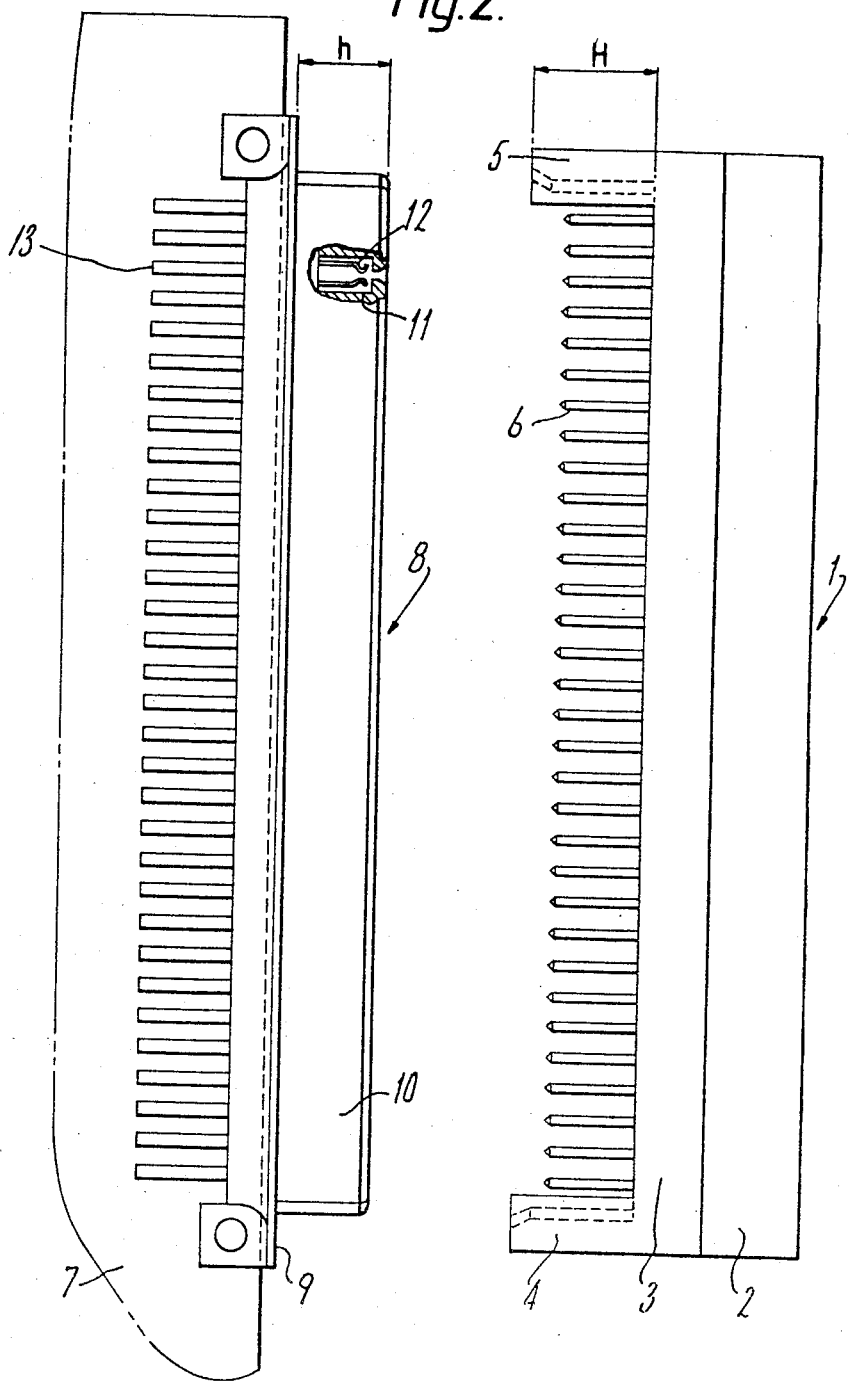
FIG. 2 shows part of a printed circuit board with an associated female connector, partly in cross-section, prior to connection with the male connector of FIG. 1.

FIG. 2 shows a portion of a printed circuit board 7 on which a conventional female connector 8 is mounted. The female connector 8 comprises an insulative housing including a longer rear part 9 and a shorter front part 10. The housing contains a plurality of cavities 11 in each of which a female contact 12 terminating in an outer terminal 13 is mounted. The front part 10 has a length equal to the distance between the flanges 4 and 5 of connector 1 and a width substantially equal to the width of the flanges. The front part 10 further has a height equal to h which is smaller than H.

Figure 3:
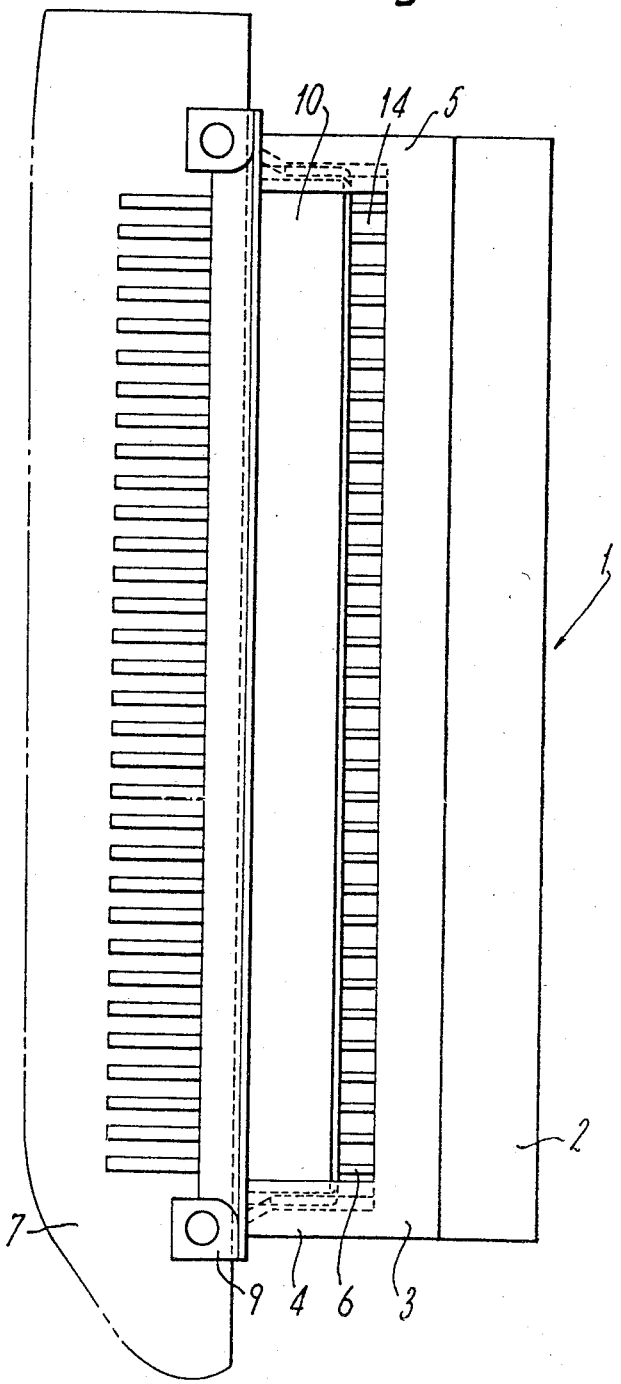
FIG. 3 shows the connectors of FIG. 2 in assembled position.

In order to prevent electrostatic charges from building up between the contacts 12 of female connector 8, and hence between components (not shown) on the printed circuit board 8 connected to these contacts, the male connector 1 is seized by means of its handle 2 and connected with the female connector 8 in such a way that the front part 10 of the female connector becomes located in the space delimited by the flanges 4 and 5 of the male connector 1 and the forward ends of the flanges abut against the ends of the rear part 9 of connector 8. The pin-shaped male contacts 6 are thereby inserted into corresponding female contacts 12 and together with the electric conductive bottom 3 of connector 1 establish an electrical connection between all the female contacts 12. In FIG. 3 the connectors 1 and 8 are shown in the fully interengaged position.

The body of the male connector 1 is so shaped that in is interengaged position with connector 8, its contacts 6 are partially unprotected or exposed. Due to H being larger than h there is a gap 14 with a height equal to H-h between parts 3 and 10 of the connectors 1 and 8. Because the connector 1 has no longitudinal lateral walls interconnecting the end flanges 4 and 5 the gap 14 is laterally open so that it gives access to the male contacts 6 inserted into the female contacts 12.

This is particularly advantageous when soldering flux contaminating the female contacts 12 has to be removed by means of a cleaning agent, e.g., Freon gas. Indeed, such a cleaning operation can then be performed without removing the male connector as the cleaning agent can enter the gap 14 and reach the female contacts.

If it is preferred to perform such a cleaning operation with the male connector removed, no gap 14 is required so that the male connector can then have a different structure than the one shown, e.g., the height H can be equal to h and/or the connector 1 can have longitudinal lateral walls between the end flanges 4 and 5.

It should be noted that contrary to a normally used male connector of which the contacts should have a very small contact resistance with the contacts of a female connector, e.g., 20 milli-ohms, a suitable discharge is obtained in the present case even with a relatively high contact resistance. This resistance may for instance be as high as 10 kilo-ohms after the connector has been used about 500 times. This means that the degree of finishing of the male contacts is far less important than usual and this reduces the manufacturing costs of the male connector.

From the above it follows that the male connector 1 of the invention brings all the female contacts 12 at the same voltage potential. If this voltage potential should be ground, it is sufficient to connect the male connector, e.g., the handle 2 thereof, to ground.

When a conventional male connector instead of the female connector 8 is connected to the printed circuit board 7, the same connectors can be used but then the female connector has to be made of an electrically conductive material.

What is claimed is:

1. An electrically conductive device for electrically interconnecting contacts of a conventional first electrical connector to prevent electrostatic charges from damaging the related circuitry when the conventional first connector is not in use, comprising:

a second connector having a bottom portion containing a plurality of separate male type contacts adapted to cooperate with corresponding female type contacts of the conventional first electrical connector;

said bottom portion of said second connector being formed from an electrically conductive plastic material to electrically interconnect said separate male type contacts within the device whereby said separate male type contacts are electrically interconnected only by the electrically conductive plastic material.

2. A device according to claim 1 wherein:

said second connector is shaped so as to leave its contacts exposed when connected with the conventional first connector to facilitate a cleaning operation of said conventional first connector contacts when connected.

3. A device according to claim 2 wherein:

said second connector comprises two end flanges and a bottom part holding said plurality of electrically interconnected contacts; and the forward ends of said flanges are adapted to abut against forwardly facing surfaces on the first connector so that a gap is provided between the connectors when mated so that the electrically interconnected contacts are exposed laterally of said second connector.

4. An electrically conductive device in combination with a conventional first electrical connector wherein:

said conventional first electrical connector comprises an insulative housing containing a plurality of female type contacts; and said electrically conductive device comprises a second connector being formed from an electrically conductive plastic material and containing a plurality of separate male type contacts mateable with the contacts in said conventional first electrical connector whereby said separate male type contacts are electrically interconnected only by the electrically conductive plastic material.

5. The combination according to claim 4 wherein:

said female type contacts have their mating portions buried within said housing.

6. The combination according to claim 4 wherein:

said insulative housing has a forward mating face:

said second connector has a forwardly facing surface, said second contacts extending forwardly from said surface; and said face and surface being spaced from each other when said connectors are fully interengaged thereby providing a gap therebetween which opens laterally of the interengaged connectors leaving said male type contacts exposed to facilitate a cleaning operation of said conventional first connector contacts while fully engaged.

7. The combination according to claim 4 wherein:

said second connector comprises two end flanges and a bottom part holding said male type contacts;

said housing of said conventional first connector comprises a longer rear part and a shorter front part containing said female type contacts; and when said connectors are interengaged, said front part is located between said end flanges and, said ends of said flanges abut against ends of said rear part, said male type contacts are inserted into said female type contacts, and a gap providing access for a cleaning operation of said female type contacts is formed between said bottom and front parts.

8. An electrically conductive device in combination with a conventional first electrical connector to prevent electrostatic charges from damaging the related circuitry when the conventional first connector is not in use wherein:

said conventional first electrical connector comprises an insulative housing containing a plurality of female contacts:

said housing hving a forward mating face;

said female contacts being positioned behind said face; and said electrically conductive device comprises a second connector formed of electrically conductive plastic material and containing a plurality of separate male contacts mateable with the female contacts in said conventional first electrical connector whereby said separate male contacts are electrically interconnected only by the electrically conductive plastic material.

* * * * *